US006179501B1

(12) United States Patent
Fulop

(10) Patent No.: US 6,179,501 B1
(45) **Date of Patent: *Jan. 30, 2001**

(54) MARKING AND ERADICATING INSTRUMENT AND METHOD OF USE OF SAME

(76) Inventor: Jacqueline I. Fulop, 280 Old Willets Path, Smithtown, NY (US) 11787

( * ) Notice: Under 35 U.S.C. 154(b), the term of this patent shall be extended for 0 days.

This patent is subject to a terminal disclaimer.

(21) Appl. No.: 09/444,157

(22) Filed: Nov. 22, 1999

Related U.S. Application Data

(63) Continuation of application No. 08/976,987, filed on Nov. 24, 1997, now Pat. No. 6,004,057.

(51) Int. Cl.[7] ..... B43K 27/04

(52) U.S. Cl. ..... 401/34; 401/606; 401/17; 401/35; 401/31

(58) Field of Search ..... 401/195, 17, 35, 401/18, 34, 6, 31, 131; 434/415, 433; 206/232; 281/30

(56) References Cited

U.S. PATENT DOCUMENTS

| | | | |
|---|---|---|---|
| D. 260,272 | 8/1981 | Horntrich | D19/6 |
| D. 279,992 | 8/1985 | Gribb | D19/43 |
| D. 295,537 | 5/1988 | Davidson | D19/43 |
| D. 295,878 | 5/1988 | Lovell | D19/43 |
| D. 299,470 | 1/1989 | Mock | D19/43 |
| D. 300,331 | 3/1989 | Horntrich | D19/43 |
| D. 306,316 | 2/1990 | Shintani | D19/36 |
| D. 307,443 | 4/1990 | Poisson | D19/43 |
| D. 307,601 | 5/1990 | Poisson | D19/43 |
| D. 309,913 | 8/1990 | Shintani | D19/43 |
| D. 316,361 | 4/1991 | Kieffer | D8/14 |
| D. 324,543 | 3/1992 | Poisson | D19/49 |
| D. 325,599 | 4/1992 | Poisson | D19/49 |
| D. 327,911 | 7/1992 | Poisson | D19/49 |

(List continued on next page.)

FOREIGN PATENT DOCUMENTS

| | | | |
|---|---|---|---|
| 2035353 | 1/1972 | (DE) | 401/34 |
| 2715359 | 10/1978 | (DE) | 401/35 |
| 296607 | 12/1988 | (EP) | 401/34 |
| 825501 | 3/1938 | (FR) . | |
| 982772 | 7/1951 | (FR) | 401/34 |
| 258999 | 10/1989 | (JP) . | |

*Primary Examiner*—David J. Walczak
(74) *Attorney, Agent, or Firm*—Alfred M. Walker

(57) ABSTRACT

A marking and/or highlighting and eradicating instrument having a marking and/or highlighting ink dispenser and an ink eradicator dispenser, which are coaxially and opposingly located each to the other and a barrel for manual gripping. Liquid dispensed from the eradicator dispenser removes the marking and/or highlighting previously dispensed upon a permanently printed surface. The marking and/or highlighting dispenser and the eradicator dispenser may each have felt wicks or other applicators for applying the marking and/or highlighting liquid and the eradicating solution.

11 Claims, 6 Drawing Sheets

U.S. PATENT DOCUMENTS

| | | | | |
|---|---|---|---|---|
| D. 329,873 | | 9/1992 | Tu | D19/48 |
| D. 331,070 | | 11/1992 | Hu | D19/43 |
| D. 332,283 | | 1/1993 | Voorhees | D19/51 |
| D. 332,964 | | 2/1993 | Giugiaro | D19/49 |
| D. 334,023 | | 3/1993 | Giugiaro | D19/49 |
| D. 336,425 | | 6/1993 | Napora | D9/338 |
| D. 340,947 | | 11/1993 | Tu | D19/43 |
| 2,481,803 | * | 9/1949 | Weaver | 401/34 |
| 3,684,389 | * | 8/1972 | Eron et al. | 401/207 |
| 3,765,780 | | 10/1973 | Gu | 401/17 |
| 3,941,488 | * | 3/1976 | Maxwell | 401/17 |
| 3,990,156 | | 11/1976 | Eigen | 35/9 B |
| 4,228,028 | | 10/1980 | Lin | 252/188.3 R |
| 4,252,845 | | 2/1981 | Griffiths | 427/273 |
| 4,277,930 | | 7/1981 | Lin | 106/19 |
| 4,525,216 | | 6/1985 | Nakanishi | 106/30 |
| 4,557,618 | * | 12/1985 | Iwata et al. | 401/34 Q |
| 4,631,203 | | 12/1986 | Schaefer | 427/145 |
| 4,681,471 | | 7/1987 | Hayduchok | 401/34 |
| 4,685,820 | | 8/1987 | Kremer | 401/260 |
| 4,726,845 | | 2/1988 | Thompson | 106/25 |
| 4,757,901 | | 7/1988 | Woods | 206/232 X |
| 4,864,618 | | 9/1989 | Wright | 380/51 |
| 4,940,628 | | 7/1990 | Lin | 428/207 |
| 4,954,174 | | 9/1990 | Imagawa | 106/27 |
| 4,979,840 | | 12/1990 | Madaus | 401/202 |
| 4,988,123 | | 1/1991 | Lin | 281/15 |
| 5,004,763 | | 4/1991 | Imagwa | 523/161 |
| 5,006,171 | | 4/1991 | Mecke | 106/21 |
| 5,017,034 | * | 5/1991 | Stary et al. | 401/35 |
| 5,036,973 | | 8/1991 | Aida | 206/232 X |
| 5,131,776 | | 7/1992 | Mott | 401/198 |
| 5,143,463 | | 9/1992 | Pozil | 401/6 |
| 5,160,266 | | 11/1992 | Landis | 434/328 |
| 5,203,638 | | 4/1993 | Redmond | 401/17 |
| 5,217,255 | | 6/1993 | Lin | 281/15.1 |
| 5,232,494 | | 8/1993 | Miller | 106/22 B |
| 5,286,061 | | 2/1994 | Behm | 283/95 |
| 5,316,574 | | 5/1994 | Fujita | 106/20 A |
| 5,324,131 | | 6/1994 | Gardner | 401/199 |
| 5,324,764 | | 6/1994 | Fujita | 524/377 |
| 5,326,388 | | 7/1994 | Miller | 106/22 B |
| 5,352,282 | | 10/1994 | Miller | 106/22 B |
| 5,362,167 | | 11/1994 | Loftin | 401/98 |
| 5,412,021 | | 5/1995 | Nakanishi | 524/523 |
| 5,427,278 | | 6/1995 | Gardner, III | 222/129 |
| 5,460,647 | | 10/1995 | Snedeker | 106/22 A |
| 5,464,470 | | 11/1995 | Brachman | 106/22 A |
| 5,478,382 | | 12/1995 | Miller | 106/22 B |
| 5,486,228 | | 1/1996 | Miller | 106/22 B |
| 5,489,331 | | 2/1996 | Miller | 106/22 B |
| 5,492,588 | | 2/1996 | Miller | 106/22 B |
| 5,498,280 | | 3/1996 | Fistner | 106/19 B |
| 5,498,282 | | 3/1996 | Miller | 106/22 B |
| 5,499,881 | * | 3/1996 | Chang | 401/17 |
| 5,503,665 | | 4/1996 | Miller | 106/21 B |
| 5,561,175 | | 10/1996 | Imagwa | 523/161 |
| 5,569,637 | | 10/1996 | Cregg | 503/201 |
| 5,599,853 | | 2/1997 | Loftin | 523/160 |
| 5,897,265 | | 4/1999 | Wilson | 401/17 X |

* cited by examiner

MARKING AND ERADICATING INSTRUMENT AND METHOD OF USE OF SAME

This application is a continuation under 37 CFR 1.53(b) of application Ser. No. 08/976,987, filed Nov. 24, 1997, now U.S. Pat. No. 6,004,057.

FIELD OF THE INVENTION

The present invention relates generally to marking applicators and dispensers and eradicators and more particularly to liquid applicators and eradicator instruments and a method of use for same.

BACKGROUND ART

Liquid marking applicators and dispensers have been known. Such applicators and dispensers may be marking or highlighting instruments, which allow marking or highlighting of selected surface areas. The applicators may be disposable and allow repetitive use ink applications, and often have felt-type wicks saturated with marking ink or highlighting ink.

Other disposable, repetitive use applicators and dispensers, using eradicators for eradicating marking ink or highlighting ink and liquids, such as bleaching agents, have been known. These eradicator applicators and dispensers often have felt-type wicks saturated with marking ink or highlighting ink eradicators.

Marking instruments, which utilize a highlighting ink applicator at an end and an unrelated ball point ink applicator coaxially located at an opposing end, such as for writing or printing ink, have also been known.

There is a need for a liquid marking and eradicating instrument having therein a liquid marker and an eradicator opposingly located each to the other. The marking and eradicating instrument should be capable of overwriting and/or highlighting printed and other material and eradicating the overwritten and/or highlighted material from the printed material.

The liquid marking and eradicating instrument should contain therein means for eradicating markings made with the marking and eradicating instrument, such as may be made by marking ink and/or highlighting ink on printed and other surfaces, and enable a user, such as a student, for example, to selectively mark and/or highlight text while studying, and then selectively eradicate portions of the marked and/or highlighted text upon memorization of these selected portions of the text. The liquid marking and eradicating instrument should enable the user to return a textbook, for example, to an unblemished state, after the highlight has been eradicated. The liquid marking and eradicating instrument should provide a convenient marking and/or highlighting ink eradicator in a single marking instrument for portability, should be inexpensive to manufacture, attractive, convenient and easy to use, eliminate the need to carry and use more than one device for marking and/or highlighting and eradicating the markings and/or highlight, facilitate writing and eradicating highlight, provide easy access, and save time in the process of marking and/or highlighting and eradicating the highlight.

There is also a need for a method for a user, such as a student, to use non-borrowable reference materials in a library, temporarily mark and/or highlight portions of the reference materials while studying same, yet also be able to erase any marked and/or highlighted portions upon completion of studying the reference materials in the library.

The method should use, for example, a single marking instrument to apply visually ascertainable transparent highlighting ink and to subsequently apply an ink eradicator solution to selectively remove all or portions of the transparent highlighting ink, thus making it visually unascertainable, while leaving the underlying permanent inked text underneath visually ascertainable.

Different color changing apparatus and methods have been known. However, none of the color changing apparatus adequately satisfies these aforementioned needs.

U.S. Pat. No. 5,492,558 (Miller) discloses color-changing compositions for highlighters;

U.S. Pat. No. 5,352,282 (Miller) discloses color-changing compositions;

U.S. Pat. No. 5,549,742 (Cancellieri) discloses an assembly or set of different color inks and an assembly of writing instruments;

U.S. Pat. No. 5,489,331 (Miller) discloses color changing compositions using acids;

U.S. Pat. No. 5,486,228 (Miller) discloses washable color changing compositions;

U.S. Pat. No. 5,464,470 (Brachman) discloses a color-changing marking composition system;

U.S. Pat. No. 5,460,647 (Snedeker) discloses a color-changing marking composition system;

U.S. Pat. No. 5,232,494 (Miller) discloses color changing compositions;

U.S. Pat. No. 5,569,637 (Cregg) discloses featuring information on a record using color;

U.S. Pat. No. 5,503,665 (Miller) discloses latent image compositions;

U.S. Pat. No. 5,498,282 (Miller) discloses color changing pan paint compositions;

U.S. Pat. No. 5,478,382 (Miller) discloses color changing compositions for use on non-porous surfaces; and U.S. Pat. No. 5,326,388 (Miller) discloses color changing compositions.

Different color removal apparatus and methods have been disclosed. However, none of the color removal apparatus and methods adequately satisfies these aforementioned needs.

U.S. Pat. No. 5,427,278 (Gardner) discloses a highlighting-ink remover applicator;

U.S. Pat. No. 5,324,131 (Gardner) discloses an ink removing applicator and ink removal method;

U.S. Pat. No. 3,941,488 (Maxwell) discloses a marker/anti-marker system;

U.S. Pat. Nos. 4,277,930 and 4,228,028 both (Lin) disclose a ball point pen, ink and eradicator system;

U.S. Pat. No. 4,252,845 (Griffiths) discloses a graphic arts ink and eradicator combination;

U.S. Pat. No. 4,681,471 (Hayduchok) discloses a kit having multicolored fluid dispenser markers together with eradicating fluid dispenser, stamps and stamp pad; and, U.S. Pat. No. 5,006,171 (Mecke) discloses an ink eradicator for inks containing triaryl methane dyestuffs.

Other marking and erasing apparatus and methods have been disclosed.

U.S. Pat. No. 5,599,853 (Loftin) discloses erasable inks;

U.S. Pat. No. 4,954,174 (Imagawa) discloses an erasable ink composition;

U.S. Pat. Nos. 5,004,763 and 5,561,175 also (Imagawa discloses water base erasable ink compositions;

U.S. Pat. No. 4,525,216 (Nakanishi) discloses an ink composition;

U.S. Pat. No. 5,412,021 also (Nakanishi) discloses a water based erasable ink composition for use in marking pens;

U.S. Pat. No. 5,362,167 (Loftin) discloses a fiber marker having an erasable ink;

U.S. Pat. Nos. 5,316,574 and 5,324,764 both (Fujita disclose an erasable ink composition for writing on an impervious surface;

U.S. Pat. Nos. 4,940,628, 4,988,123 and 5,217,255 all (Lin) disclose an erasable system having marking surface and erasable ink composition;

U.S. Pat. No. 5,017,034 (Stary) discloses a marker and pen combination having transverse and longitudinally spaced tips;

U.S. Pat. No. 5,203,638 (Redmond) discloses a writing instrument for alternately writing in fluorescent transparent and non-transparent ink;

U.S. Pat. No. 3,990,156 (Eigen) discloses a constructed response method with invisible answer indicator for preventing cheating;

U.S. Pat. No. 4,631,203 (Schaefer) discloses a latent imaging and developer system;

U.S. Pat. No. 5,160,266 (Landis) discloses a mix and match invisible ink game;

U.S. Pat. No. 5,131,776 (Mott) discloses an aqueous permanent coloring composition for a marker;

U.S. Pat. No. 4,726,845 (Thompson) discloses an hybrid marking instrument and writing ink composition;

U.S. Pat. No. 4,864,618 (Wright) discloses an automated transaction system with modular print head having print authentication feature;

U.S. Pat. No. 5,286,061 (Behm) discloses a lottery ticket having validation data printed in developable invisible ink;

U.S. Design Pat. Nos. D340,947, D329,873 (Tu), U.S. Pat. Nos. D260,272, D300,331 (Horntrich), U.S. Pat. No. D295,537 (Davidson), U.S. Pat. No. D299,470 (Mock), U.S. Pat. Nos. D307,443, D307,601, D324,543, D325,599, D327, 911, (Poisson), U.S. Pat. No. D309,913 (Shintani), U.S. Pat. No. D316,361 (Kieffer), U.S. Pat. No. D332,283 (Voorhees), U.S. Pat. Nos. D332,964, D334,023 (Giugiaro), all disclose various marking instruments;

U.S. Design Pat. No. D336,425 (Napora) discloses a double ended marking instruments;

U.S. Design Pat. No. D295,878 (Lovell) discloses a dual applicator marking instrument;

U.S. Design Pat. No. D306,316 (Shintani) discloses a twin-nibbed marking instrument;

U.S. Design Pat. No. D331,070 (Hu) discloses a casing for a marking instrument; and, U.S. Design Pat. No. D279,992 (Gribb) discloses a dual tip marking instrument.

For the foregoing reasons there is a need for a liquid marking and eradicating instrument having therein a marker and/or highlighter and an eradicator opposingly located each to the other. The liquid marking and eradicating instrument should be capable of marking and/or highlighting printed and other material and eradicating the markings and/or highlight from the printed material.

The liquid marking and eradicating instrument should contain therein means to eradicate markings and/or highlight on printed and other surfaces, and enable a user, such as a student, for example, to selectively mark and/or highlight text while studying, and then selectively eradicate portions of the marked and/or highlighted text upon memorization of these selected portions of the text. The liquid marking and eradicating instrument should enable the user to return a textbook, for example, to an unblemished state, after the highlight has been eradicated. The liquid marking and eradicating instrument should provide a convenient marker and/or highlighting ink eradicator in a single marking instrument for portability, should be inexpensive to manufacture, attractive, easy and convenient to use, eliminate the need to carry and use more than one device for marking and/or highlighting and eradicating the markings and/or highlight, facilitate writing and eradicating markings and/or highlight, provide easy access, and save time in the process of marking and/or highlighting and eradicating the markings and/or highlight.

There is also a need for a method for a user, such as a student, to use non-borrowable reference materials in a library, temporarily mark and/or highlight portions of the reference materials while studying same, yet also be able to erase any marked and/or highlighted portions upon completion of studying the reference materials in the library.

The method may use a single marking instrument to apply visually ascertainable transparent highlighting ink and to subsequently apply an ink eradicator solution to selectively remove all or portions of the transparent highlighting ink, thus making it visually unascertainable, while leaving the underlying permanent inked text underneath visually ascertainable.

OBJECTS OF THE INVENTION

It is an object of the present invention to provide a liquid marking and eradicating instrument having therein a marker and/or highlighter and an eradicator opposingly located each to the other. The liquid marking and eradicating instrument should be capable of marking and/or highlighting printed and other material and eradicating the markings and/or highlight from the printed material.

It is also an object of the present invention to provide a marking and/or highlighting instrument, which contains therein means to eradicate markings and/or highlighting ink on printed surfaces.

It is also an object of the present invention to enable a user, such as a student, to selectively mark and/or highlight text while studying, but also be able to selectively eradicate portions of the marked and/or highlighted text upon memorization of these selected portions of the text.

It is yet another object of the present invention to provide a convenient marker and/or highlighter and marker and/or highlighter eradicator in a single marking instrument for easy access and saving time.

It is also an object of the present invention to enable a user, such as a reader, to use a printed publication, such as a book or specialized textbook, with marking and/or highlighting ink to selectively underscore selected topics of the textbook, yet further enable the reader to remove the markings and/or highlighted ink to return the textbook to an unblemished state after use of the textbook has been accomplished.

It is also an object of the present invention to provide a kit for a user, such as a student, so that the user can study course material by selectively marking and/or highlighting text and then narrowing the portion of the text to be studied in the future by eradicating the already learned material.

It is yet another object of the present invention to provide a method for a user, such as a student, to use non-borrowable reference materials in a library and to temporarily mark and/or highlight portions of the reference materials while studying same, yet also be able to erase any marked and/or highlighted portions upon completion of studying the reference materials in the library.

It is yet another object of the present invention to enable a user, such as a student, to restore a used textbook to an unblemished state upon completion of use of the textbook and to increase and augment the value of the textbook when the textbook is re-sold by the student.

It is also an object of the present invention to enable a user, such as a student, to temporarily remove marked and/or highlighted portions of a textbook or other published material so that the material can be photocopied, or sent by electronic facsimile transmission (i.e. "faxed") without marking and/or highlighting ink thereon, and yet enable the student to restore the markings and/or highlighting with marking and/or highlighting ink after completion of photocopying or faxing of the selected portion of the textbook or other published material.

It is yet another object of the present invention to provide a marking and/or highlighting ink applicator marking instrument, more particularly, to a marking and/or highlighting ink barrel dispenser having an erasable ink applicator, coaxially positioned at an opposite end of the barrel, which erasable ink applicator removes the marking and/or highlighting ink previously dispensed upon a permanently printed surface.

It is yet another object of the present invention for the barrel of the aforementioned marking and/or highlighting ink applicator to be designed for manual gripping, and have at one end the highlighting ink dispenser, such as felt, which wick is soaked with marking and/or transparent highlighting ink and the opposite end to have the erasable marking and/or ink applicator, which may also be dispensed from a wick or other appropriate dispensers, such as a roller ball applicator or a squeeze tube. Both the oppositely positioned applicator portions should be closed by a removable air tight cap. Each cap should engage a reciprocal collar end of the sleeve barrel within which barrel the respective wicks are placed.

SUMMARY OF THE INVENTION

In keeping with these objects and others which may become apparent, the present invention provides a marking and/or highlighting and eradicating instrument having a marking and/or highlighting ink dispenser and an ink eradicator dispenser, which are coaxially and opposingly located each to the other. Liquid dispensed from the eradicator dispenser removes the marking and/or highlighting previously dispensed upon a permanently printed surface.

The marking and/or highlighting and eradicating instrument may be used with marking ink, highlighting ink, or other suitable liquid.

The marking and/or highlighting and eradicating has a barrel, designed for manual gripping, when used for example with highlighting ink, includes at one end the marking and/or highlighting ink dispenser, such as a felt wick, which wick is soaked with transparent highlighting ink. At the opposite end is provided the ink eradicator applicator, wherein the eradicating ink may also be dispensed from a wick or other appropriate dispensers, such as a roller ball applicator or squeeze tube. Each of the oppositely positioned applicator portions are closed by a removable air tight cap. Each cap engages a reciprocal collar end of the sleeve barrel within which barrel the respective wicks are placed.

USE AND OPERATION OF THE INVENTION

While reading assigned material for an academic school's course, pertinent new material is marked or highlighted for future review and memorization. This can be accomplished, for example, with the highlighting ink end portion of the marking instrument of the present invention. But, as material is reviewed and committed to memory, the highlighted areas can be narrowed down. The material already learned by a student can be erased to make the material less cumbersome and more efficient for learning, and to increase memory efficiency. This can be established by erasing the learned material with the eradicator end of the marking instrument of the present invention.

It is not necessary to search, find and retrieve a separate marking instrument to have this erasing activity occur, since the marking instrument of the present invention is all inclusive and has both functions in one, single convenient marking instrument.

In the absence of the present invention, notes are taken with a pen or pencil while simultaneously highlighting the material, many times, while studying. Time is lost searching for use of the pen or pencil while the prior art conventional highlighter marker is in the user's hand and vice versa, time is lost searching for a conventional highlighter marking instrument while the pen or pencil is in the user's hand. There is a discrepancy in the efficiency of the user's time, even if what the user is searching for is right next to the user.

Therefore, to improve the management of the user's time and time efficiency during studying, the double-ended marking instrument of the present invention has a highlighter on one end and a highlighting ink eradicator component on the other end.

With the present invention, while studying, after highlighting any material, it is not necessary for the user to find a separate utensil for eradicating the material already studied. The highlighter portion of the marking instrument of the present invention is simply flipped around to erase the material initially highlighted which, at a later time is reviewed, learned and committed to memory.

In addition, many college and graduate level courses have a reference list referring to material requiring research in the Reference Section of the library. These textbooks cannot leave the library and they also cannot be marked or highlighted in. Pages can only be photocopied and then a problem of photocopy machine lines and purchasing copy cards exist. With the marking instrument of the present invention, learning material required for a course can be read and highlighted at a relaxed pace. The relevant material from the textbooks in the Reference Section can actually be written in with highlighting ink, initially. After the pertinent information is highlighted and gathered, the marking instrument of the present invention can be turned around to erase any of the material in the Reference textbook which was initially highlighted.

Moreover, college and graduate school textbooks are always being bought and sold at academic institutions throughout the country today. When a textbook is sold back to the bookstore, at the end of a semester, a higher initial purchase price is refunded to the student, if less marks are made in the book. Therefore, the selling price of a book correlates to the shape it's in at the time it's being sold back to the bookstore. With the marking instrument of the present invention, the textbook can be utilized for learning purposes and highlighted in throughout the semester without any worries of how much it will be worth at the end of the semester. When the course is over and the time comes to sell the textbook back to the bookstore, the marking instrument of the present invention can be flipped around and all the blemishes of the highlighted areas can be simply eradicated before getting evaluated for a refund.

Furthermore, while studying, it is difficult to keep track of what words or phrases were previously highlighted. The same material can frequently be highlighted repetitively. When this occurs and as soon as it is realized, the marking instrument of the present invention can be flipped around to erase the repeated words, phrases and/or thoughts already highlighted. Again, this allows for a more efficient way of learning by decreasing the quantity of the material and increasing the quality of what is being learned.

Also with respect to use of the marking instrument of the present invention, computer printed and/or photocopied hand-outs are sometimes written and highlighted on for ease of locating and identifying words or phrases. Photocopying and/or faxing these dittos does not allow words or phrases highlighted with darker markers to show up. If highlighted sheets require photocopying or faxing, the marking instrument of the present invention can again be flipped around to erase the highlighted areas prior to photocopying or faxing them.

The uses of the marking instrument of the present invention are endless, and the present invention helps increase the efficiency, ease and excitement of acquiring knowledge, as the user learns.

DESCRIPTION OF THE DRAWINGS

These and other features, aspects, and advantages of the present invention will become better understood with regard to the following description, appended claims, and accompanying drawings where:

DETAILED DESCRIPTION OF THE DRAWINGS

Figure 1:
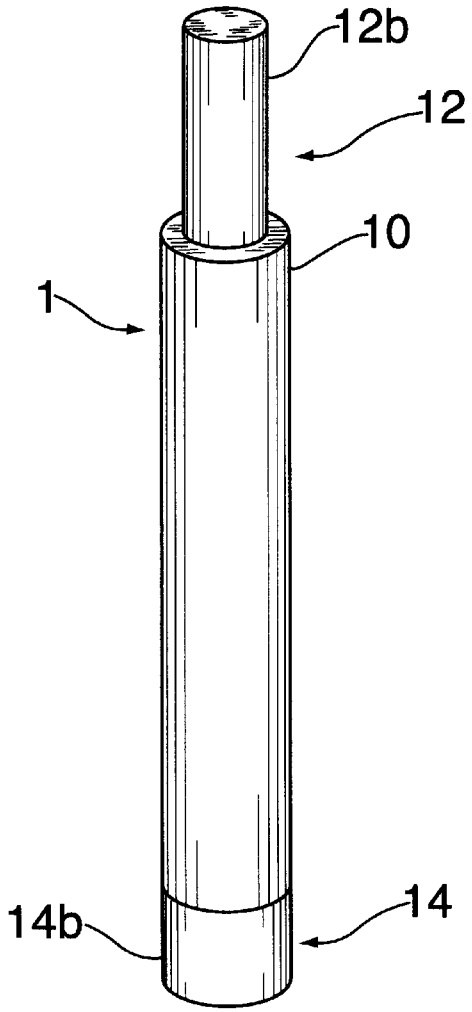
FIG. 1 is a perspective view of a liquid marking and eradicating instrument of the present invention.
Figure 2:
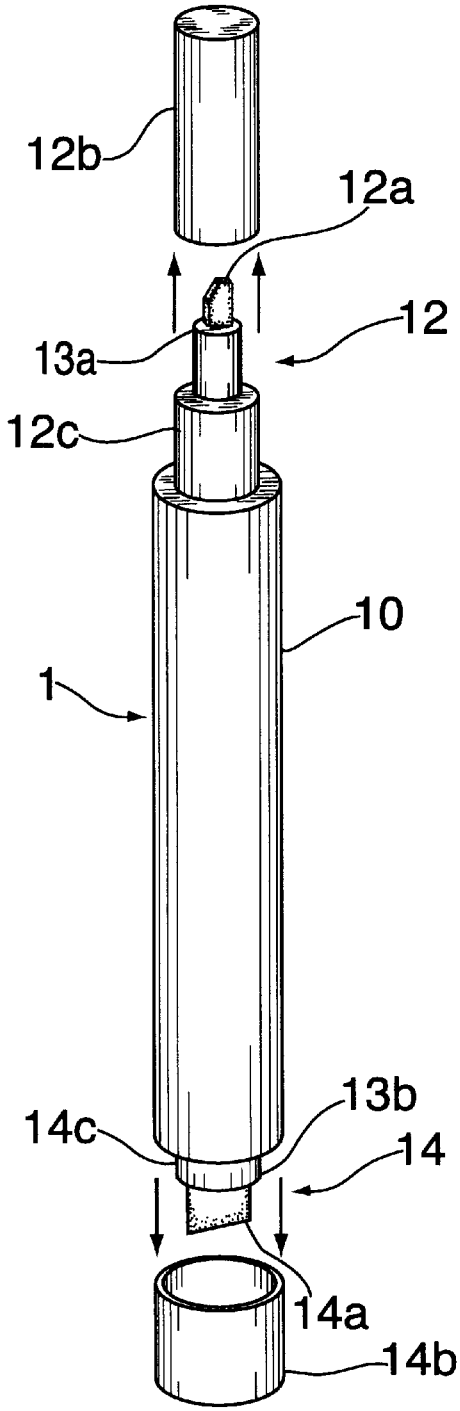
FIG. 2 is an exploded perspective view of the liquid marking and eradicating instrument of FIG. 1, shown in an open position.
Figure 4:
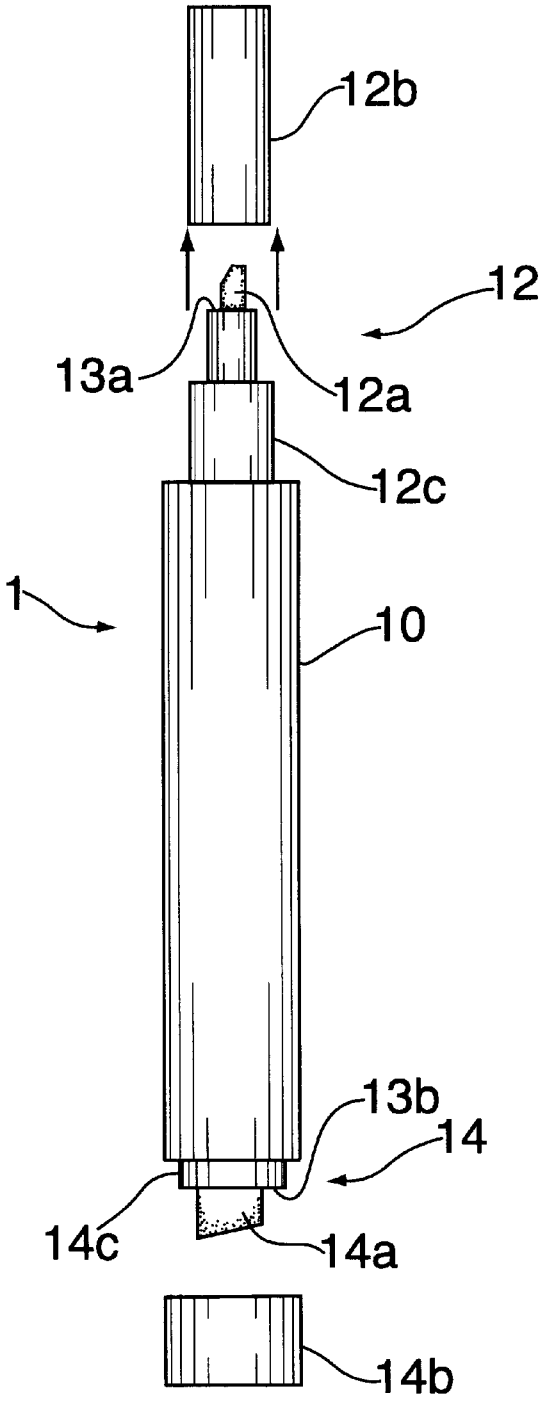
FIG. 4 is an exploded side elevational view of the liquid marking and eradicating instrument of the present invention shown in FIG. 1.

The preferred embodiments of the present invention will be described with reference to FIGS. 1–9 of the drawings. Identical elements in the various figures are identified with the same reference numbers.

As shown in FIGS. 1–6, 8, and 9, a liquid marking and eradicating instrument 1 has hollow barrel sleeve 10 having liquid dispenser 12, which dispenses liquid therefrom upon a permanently printed surface, and liquid eradicator dispenser 14, coaxially and opposingly located each to the other. The eradicator dispenser 14 dispenses eradicator liquid therefrom and removes dried liquid previously dispensed therefrom the liquid dispenser 12 upon the permanently printed surface.

The marking and/or highlighting marking instrument 1 may be used with marking ink, highlighting ink, paint, or other suitable liquid, the preferred embodiment being further described herein having highlighting ink, and in particular transparent highlighting ink, and highlighting ink eradicator solution therein.

The hollow barrel sleeve 10 is designed for manual gripping. A transparent liquid ink solution contained therein the liquid ink dispenser 12 is dispensed from and therethrough wick 12*a*, which may be of felt or other suitable material, the wick 12*a* being soaked with the transparent liquid ink. The opposingly located liquid ink eradicator dispenser 14, has an eradicating ink solution which is dispensed from and therethrough wick 14*a* or other suitable dispenser, such as a roller ball applicator or squeeze tube (not shown). The liquid ink dispenser wick 12*a* and the liquid eradicator dispenser wick 14*a* are opposingly located at ends 13*a* and 13*b* of the hollow barrel sleeve 10.

The hollow barrel sleeve 10 has wall 16, which separates the liquid ink dispenser 12 of the hollow barrel sleeve 10 from the liquid ink eradicator dispenser 14. The wall 16 extends internally to and transversely across the hollow barrel sleeve 10 and segregates the transparent liquid ink from the eradicating ink solution therein and defines highlighting ink reservoir 15*a* and eradicating ink solution reservoir 15*b*.

The liquid ink dispenser 12 and the opposingly located liquid ink eradicator dispenser 14, respectively have respective removable air tight caps 12*b*, 14*b*. The hollow sleeve barrel 10 has opposing reciprocal collar ends 12*c* and 14*c*, respectively located adjacent the liquid ink dispenser wick 12*a* and the liquid eradicator dispenser wick 14*a*, respectively. Each of the caps 12*b* and 14*b* engage the respective reciprocal collar ends 12*c* and 14*c* of the hollow sleeve barrel 10 and provides substantially air tight closure of the liquid ink dispenser wick 12*a* and the liquid eradicator wick 14*a* from external environments, when the liquid marking and eradicating instrument 1 is not in use. The respective end caps 12*b* and 14*b* are removed from the respective reciprocal collar ends 12*c* and 14*c* of the liquid marking and eradicating instrument 1 when the respective liquid ink dispenser 12 and the liquid eradicating dispenser 14 are in use, either individually or both. The reciprocal collar ends 12*c* and 14*c* each have cross sectional diameters smaller than cross sectional diameter of the sleeve barrel 10.

Figure 3:
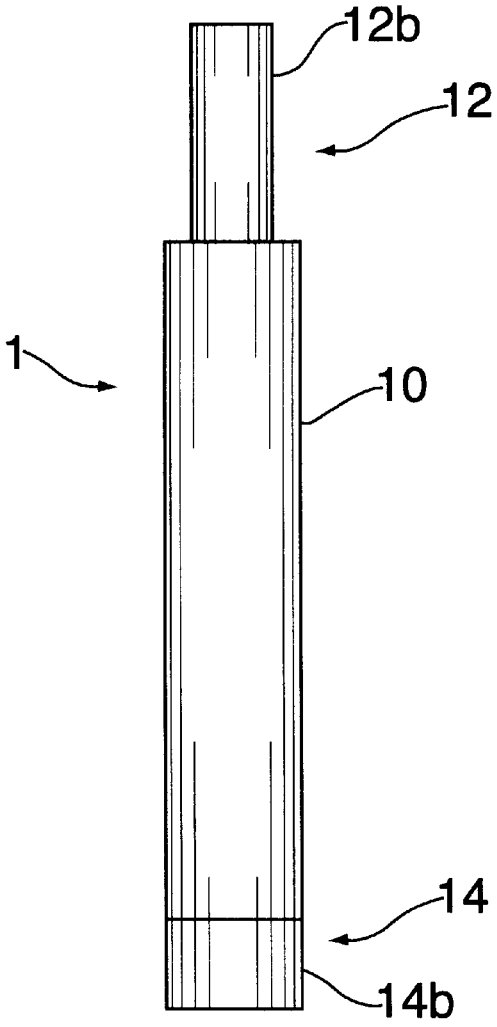
FIG. 3 is a side elevational view of the liquid marking and eradicating instrument of the present invention shown in FIG. 1.
Figure 3A:
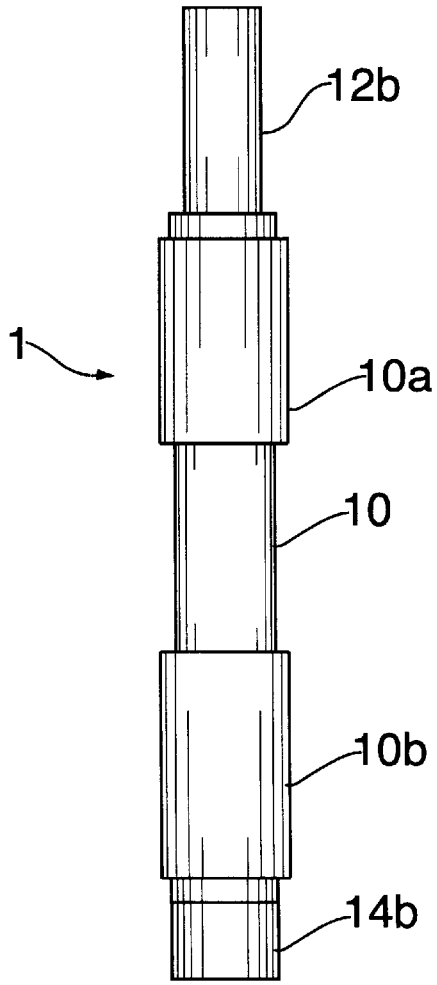
FIG. 3A is a side elevational view of an alternate cushioned embodiment of a liquid marking and eradicating instrument of the present invention.
Figure 4A:
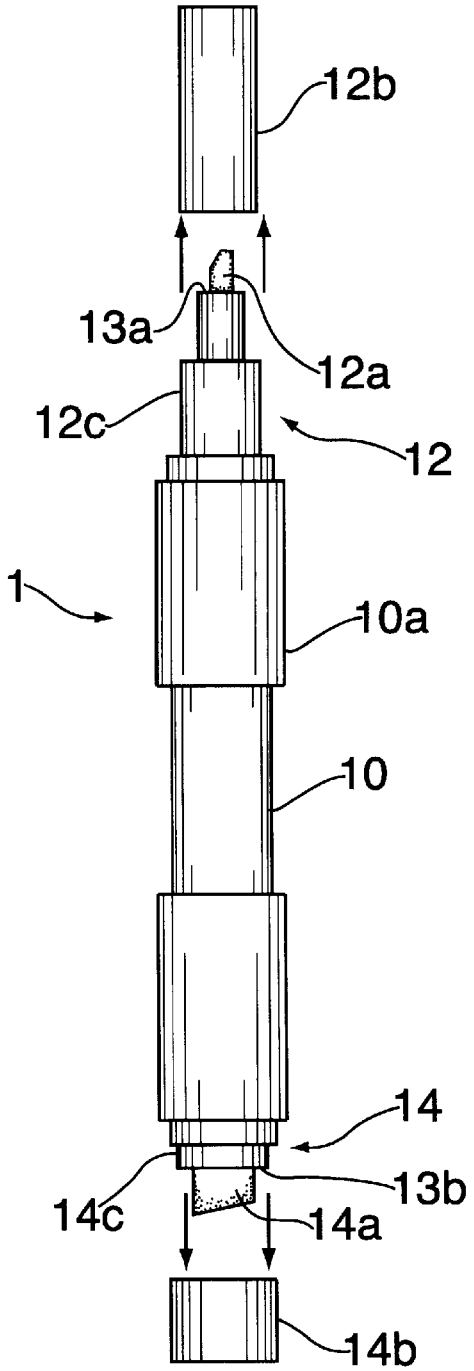
FIG. 4A is an exploded side elevational view of the alternate cushioned embodiment shown in FIG. 3A.
Figure 5:
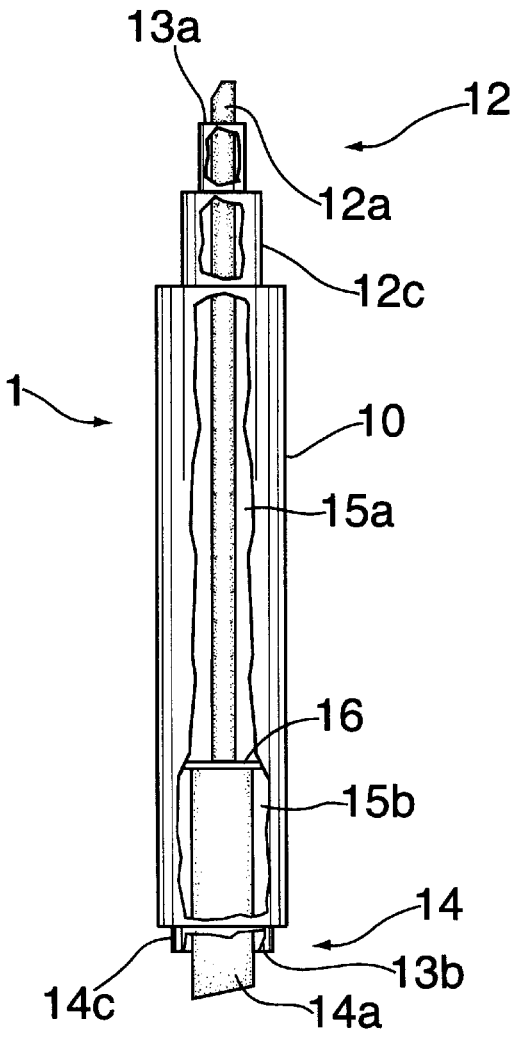
FIG. 5 is a side elevational view in partial cross section of the of the liquid marking and eradicating instrument of the present invention shown in FIG. 1.
Figure 6A:
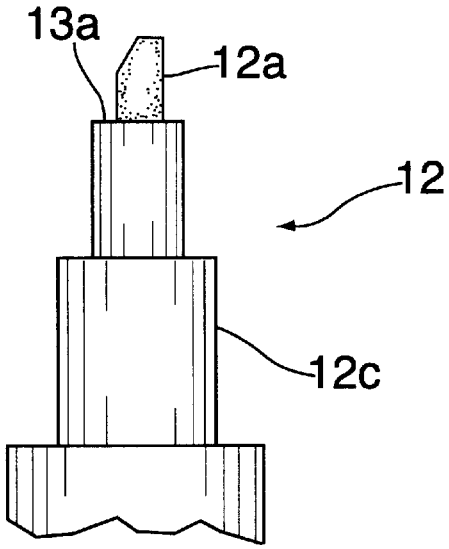
FIG. 6A is a close up view of a wick dispensing portion of transparent liquid ink dispensing portion of the present invention shown in FIG. 3.
Figure 6:
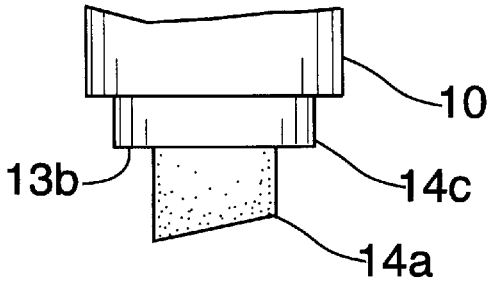
FIG. 6 is a close-up view of a wick dispensing portion f the liquid marking, and eradicating instrument of the present invention shown in FIG. 3.

Furthermore, as shown in FIGS. 3A and 4A, the hollow barrel sleeve 10 of the liquid marking and eradicating instrument 1 may alternately have annular gripping cushions 10*a* and 10*b*, of rubber, foam or other suitable material, such as a malleable cushion of a flexible polymer, which conforms to the contours of the fingers of the user, such as writing pens sold under the trademark Dr. Grip®.

It is further noted that the wick 14*a* of ink eradicator dispenser 14 is preferably wider than the wick 12*a* of liquid ink dispenser 12, so that when the user applies the ink eradicator solution from the wick 14*a*, the solution will leave a wider swath of ink eradicator solution over the previously applied swath of transparent liquid ink.

The liquid marking and eradicating instrument 1 may be of metal, thermoplastic, thermosetting polymer, rubber, or other suitable material or combination thereof.

The liquid ink dispensed from the liquid ink dispenser 12 may be conventional transparent liquid ink, such as described, for example, in U.S. Pat. No. 5,498,280 (Fistner, et al) or other suitable transparent liquid ink.

Furthermore, the liquid ink eradicator solution dispensed from the liquid ink eradicator dispenser 14 is a solution which dissolves the transparent liquid ink, leaving the transparent liquid ink visually unascertainable, but which leaves underlying textural permanent indicia, such as printed ink, untouched and visually ascertainable.

The liquid ink eradicator solution may be bleach, such as hypochlorites, among others, as described in U.S. Pat. No. 5,427,278 (Gardner) ) or other suitable transparent liquid ink eradicator solution.

Figure 7B:
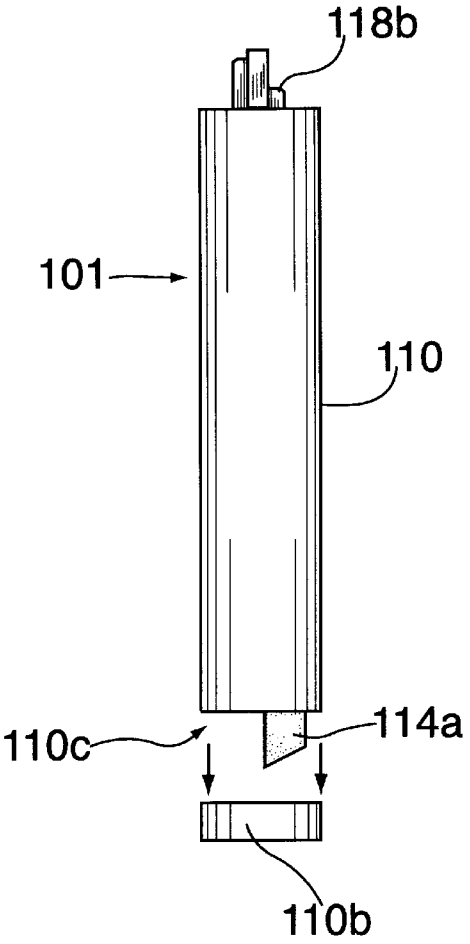
FIG. 7B is a side elevational view of the liquid marking and eradicating instrument as in FIG. 7, shown with the ink eradicator portion in use.
Figure 7A:
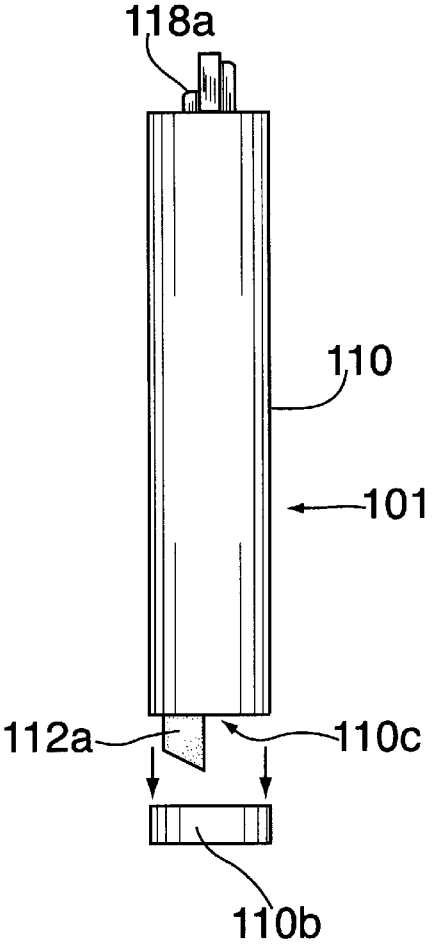
FIG. 7A is a side elevational view of the liquid marking and eradicating instrument of FIG. 7, shown with transparent liquid ink portion in use.
Figure 7:
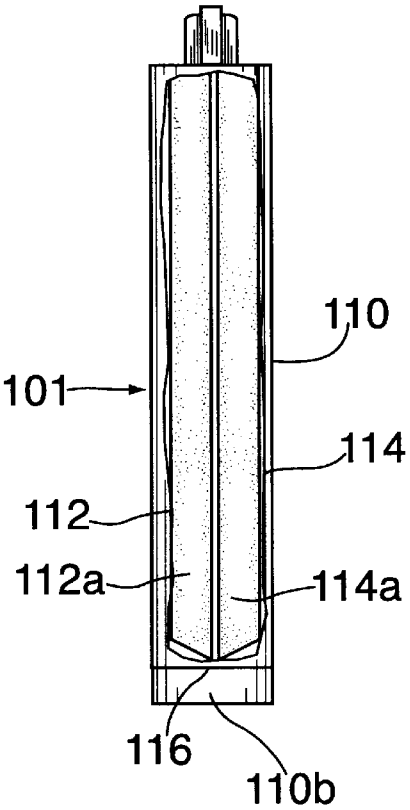
FIG. 7 is a side elevational view in partial cross section of an alternate embodiment of a liquid instrument.

As shown in FIGS. 7, 7A and 7B, in another embodiment of a liquid marking and eradicating instrument 101, hollow barrel sleeve 110 has coaxially aligned liquid ink dispenser 112 having wick 112*a* and liquid ink eradicator dispenser 114 having wick 114*a*. However, both the liquid ink dispensers 112 and the liquid ink eradicator dispensers 114 face the same direction, so that in a storage portion of non-use, the distal ends of the respective wicks 112*a* and 114*a* are adjacent each other within the hollow barrel sleeve 110, but are separated from each other by axially extending and longitudinally extending wall 116 internally to the hollow barrel sleeve 110.

The liquid ink dispensing wick 112*a* is advanced from and out of open mouth end 110*c* of the hollow barrel sleeve 110 by slide member 118*a*, and the ink eradicator wick 114*a* is advanced from and out of open mouth end 110*c* of the hollow barrel sleeve 110 by slide member 118*b*. Moreover, the open mouth end 110*c* of the hollow barrel sleeve 110 is closed by cap 110*b*, sealing the liquid ink dispensing wick 112*a* and the ink eradicator wick 114*a* from external environments when the liquid marking and eradicating instrument 101 is not in use.

Figure 8:
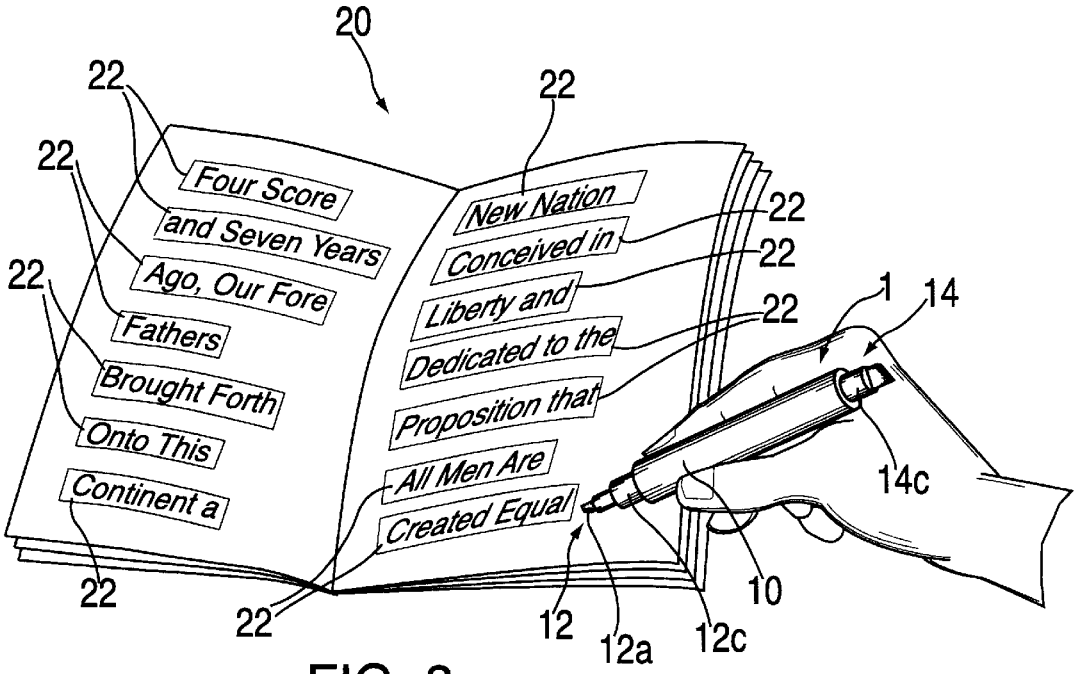
FIG. 8 is a perspective view of use of the liquid portion of the liquid marking and eradicating instrument of the present invention shown in FIG. 1, wherein a user's hand and book are environmental in nature; and, FIG. 9 is a another perspective view of the use of the liquid portion of the liquid marking and eradicating instrument of the present invention shown in FIG. 1, wherein the user's hand and the book are environmental in nature.

As shown in FIG. 8, a method of use of the present invention is described. For example, while reading assigned material for an academic school's course, a user highlights pertinent text material by liquid area swaths 22 with a transparent liquid ink solution for future review and memorization. This can be accomplished with liquid ink dispenser 12 of the liquid marking and eradicating instrument 1 of the present invention. As text material is reviewed and committed to memory, the user can visually decrease the highlighted area swaths 22 and eradicate unwanted portions of area swaths 22 with the eradicator solution dispensed from the ink eradicator dispenser 14.

Figure 9:
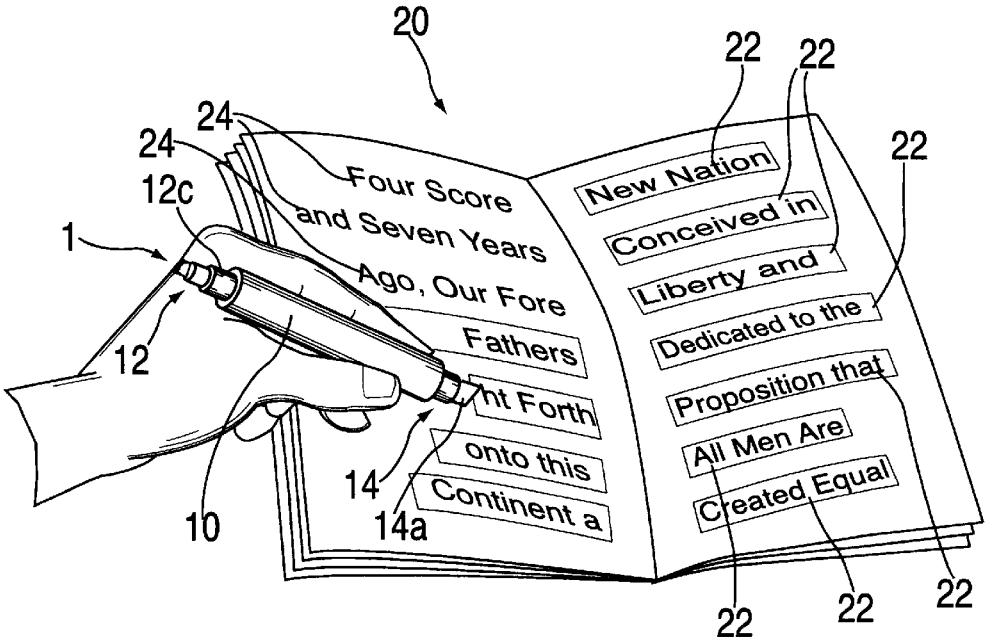

Therefore, as shown in FIG. 9, highlighted area swaths 22 of the text material already learned by a student can be eradicated, leaving unblemished text 24, to make the reading material less cumbersome and more efficient for learning, and to increase memory efficiency. This is established by eradicating the swaths 22 previously imprinted over the already learned material with the eradicator ink solution from the ink eradicator dispenser of the liquid marking and eradicating instrument 1 of the present invention.

It is therefore not necessary to search, find and retrieve a separate marking instrument for eradicating a portion or portions of the highlighted text, since the liquid marking and eradicating instrument 1 of the present invention is all inclusive and has both functions in one, single convenient marking instrument.

With the present invention, while studying, after liquid any printed material, it is not necessary for the user to find a separate utensil for eradicating the highlighted swaths 22 of the material already studied. Highlighter ink dispenser 12 of the liquid marking and eradicating instrument 1 of the present invention is simply flipped around to use the ink eradicator dispenser 14 of the liquid marking and eradicating instrument 1, to eradicate the material initially highlighted, thus revealing unblemished text 23, which, at a later time may be reviewed, learned and committed to memory.

Although the present invention has been described in considerable detail with reference to certain preferred versions thereof, other versions are possible. Therefore, the spirit and scope of the appended claims should not be limited to the description of the preferred versions contained herein.

What is claimed is:

1. A dual function highlighting pen for sequentially marking and eradicating transparent highlighting ink over selected printed material on pages of printed material of a printed publication comprising a single one piece barrel, said barrel having a dispensing means for first temporarily highlighting liquid ink over selected printed material on pages of printed material from said printed publication, said dispensing means of said one piece barrel having therein a first felt wick having soaked therein said transparent highlighting ink, said first felt wick dispensing said transparent highlighting ink from said barrel over selected printed material; and a means for subsequently removing in stages said transparent highlighting ink from selected printed material, said removal means comprising said barrel having therein a second felt wick, said second wick having soaked therein a highlighting liquid ink eradicator solution which eradicates said transparent highlighting ink but which will not damage any selected print material, said first felt wick and said second wick being coaxially located within said barrel;

said barrel having a partition wall therein dividing and separating the interior of said barrel into first and second axially aligned reservoirs containing highlighting ink and eradicator solution, respectively, said first wick extending within said first reservoir up to one side of said partition wall and said second wick extending within said second reservoir up to an opposite side of said partition wall, said partition wall separating said first wick from said second wick;

said highlighting ink being first delivered from a first end of said barrel in a first position of use and said eradicator solution being subsequently delivered from an opposite end of said barrel in a second inverted position of use of said barrel.

2. The highlighting pen of claim 1 in which said barrel has an annular gripping cushion thereon.

3. The highlighting pen of claim 2 in which said annular gripping cushion is made of a flexible polymer which conforms to the contours of the fingers of the user.

4. A dual function highlighting pen comprising:

a one piece barrel;

a first reservoir of highlighting fluid in said barrel;

first means comprising a first felt wick in said barrel within said first reservoir to deliver highlighting fluid from said first reservoir to mark with highlighting fluid selected printed material on a page of printed material;

a second reservoir of fluid in said barrel capable of eradicating the highlighting from printed material without damaging any printed material;

second means comprising a second felt wick in said barrel within said second reservoir for delivering said eradicating fluid to said highlighting on selected printed material for erasing said highlighting without damaging any printed material;

said first and said second reservoir and means are located at the same end of said pen, in side by side relationship with said wicks within an open mouth of said barrel, and slide members to advance or retract each of said wicks as selected out of said barrel; and said first and second means are enclosed by a removable air tight cap.

5. The highlighting pen of claim 4 the which said barrel has an annular gripping cushion thereon.

6. The highlighting pen of claim 5 in which said annular gripping cushion is made of flexible polymer which conforms to the contours of the fingers of the user.

7. A kit for educational study to assist students and other readers of text to selectively and temporarily dispense transparent highlighting liquid ink upon selected indelible printed portions of a text, and to subsequently remove said highlighting ink without damaging indelible printed text underneath comprising in combination:

an educational publication having indelible selected printed material on pages therein to be temporarily covered by transparent highlighting ink from a dual function highlighting and eradicating pen in order to narrow the portion of the text to be studied in the future;

said dual function highlighting pen for sequentially marking and eradicating said transparent highlighting ink over said selected printed material on pages of printed material of said educational publication;

said pen having a single one piece barrel, said barrel having a dispensing means for first temporarily dispensing transparent highlighting ink over said selected printed material on said pages of printed material from said educational publication, said dispensing means of said one piece barrel having therein a first felt wick having soaked therein said transparent highlighting ink, said first felt wick dispensing said transparent highlighting ink from said barrel over said selected printed material;

a means for subsequently removing in stages said transparent highlighting ink from said selected printed material, said removal means comprising said barrel having therein a second felt wick, said second wick having soaked therein a highlighting liquid ink eradicator solution which eradicates said transparent highlighting ink but which will not damage said selected printed material;

said first felt wick and said second wick being coaxially located within said barrel;

said barrel having a partition wall therein separating said barrel into first and second axially aligned reservoirs containing said highlighting ink and eradicator solution, respectively, with said first and second wicks each extending from an opposite side of said partition wall to and out of opposite ends of said barrel, thereby separating said first wick from said second wick; and, said highlighting ink being first delivered from a first end of said barrel in a first position of use and said eradicator solution being subsequently delivered from an opposite end of said barrel in a second inverted position of use of said barrel.

8. A dual function highlighting pen for sequentially marking and eradicating transparent highlighting ink over selected printed material on pages of printed material of a printed publication comprising a single one piece barrel, said barrel having a dispensing means for first temporarily highlighting liquid ink over selected printed material on pages of printed material from said printed publication, said dispensing means of said one piece barrel having therein a first felt wick having soaked therein said transparent highlighting ink, said first felt wick dispensing said transparent highlighting ink from said barrel over selected printed material; and a means for subsequently removing in stages said transparent highlighting ink from selected printed material, said removal means comprising said barrel having therein a second felt wick, said second wick having soaked therein a highlighting liquid ink eradicator solution which eradicates said transparent highlighting ink but which will not damage any selected print material, said first felt wick and said second wick being coaxially located within said barrel;

said barrel having a partition wall therein dividing and separating the interior of said barrel into first and second axially aligned reservoirs containing highlighting ink and eradicator solution, respectively, said first transparent highlighting ink soaked wick extending within said first reservoir up to one side of said partition wall and said second highlighting ink eradicator soaked wick extending within said second reservoir up to an opposite side of said partition wall, said partition wall separating said first axially aligned reservoir from said second axially aligned reservoir;

said highlighting ink being first delivered from a first end of said barrel in a first position of use and said eradicator solution being subsequently delivered from an opposite end of said barrel in a second inverted position of use of said barrel.

9. The highlighting pen of claim 8 in which said barrel has an annular gripping cushion thereon.

10. The highlighting pen of claim 9 in which said annular gripping cushion is made of a flexible polymer which conforms to the contours of the fingers of the user.

11. A kit for educational study to assist students and other readers of text to selectively and temporarily dispense transparent highlighting liquid ink upon selected indelible printed portions of a text, and to subsequently remove said highlighting ink without damaging indelible printed text underneath comprising in combination;

an educational publication having indelible selected printed material on pages therein to be temporarily covered by transparent highlighting ink from a dual function highlighting and eradicating pen in order to narrow the portion of the text to be studied in the future;

said dual function highlighting pen for sequentially marking and eradicating said transparent highlighting ink over said selected printed material on pages of printed material of said educational publication;

said pen having a single one piece barrel, said barrel having a dispensing means for first temporarily dispensing transparent highlighting ink over said selected printed material on said pages of printed material from said educational publication, said dispensing means of said one piece barrel having therein a first felt wick having soaked therein said transparent highlighting ink, said first felt wick dispensing said transparent highlighting ink from said barrel over said selected printed material;

a means for subsequently removing in stages said transparent highlighting ink from said selected printed material, said removal means comprising said barrel having therein a second felt wick, said second wick having soaked therein a highlighting liquid ink eradicator solution which eradicates said transparent highlighting ink but which will not damage said selected printed material;

said first felt wick and said second wick being coaxially located within said barrel;

said barrel having a partition wall therein separating said barrel into first and second axially aligned reservoirs containing said highlighting ink and eradicator solution, respectively, said first transparent highlighting ink soaked wick extending within said first reservoir up to one side of said partition wall and said second highlighting ink eradicator soaked wick extending within said second reservoir up to an opposite side of said partition wall, said partition wall separating said first axially aligned reservoir from said second axially aligned reservoir; and, said highlighting ink being first delivered from a first end of said barrel in a first position of use and said eradicator solution being subsequently delivered from an opposite end of said barrel in a second inverted position of use of said barrel.

* * * * *